US006460976B1

(12) United States Patent
Oikawa

(10) Patent No.: US 6,460,976 B1
(45) Date of Patent: Oct. 8, 2002

(54) PRINTING APPARATUS HAVING CONTROL MEANS OF CONTROLLING TIMING FOR DRIVING BLOCKS OF PRINT ELEMENTS

(75) Inventor: Masaki Oikawa, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/467,979

(22) Filed: Dec. 21, 1999

(30) Foreign Application Priority Data

Dec. 28, 1998 (JP) ..... 10-374795

(51) Int. Cl.[7] ..... B41J 2/05
(52) U.S. Cl. ..... 347/57
(58) Field of Search ..... 347/56, 54, 20, 347/5, 10, 11, 13, 12, 57

(56) References Cited

U.S. PATENT DOCUMENTS

| | | | |
|---|---|---|---|
| 4,313,124 A | 1/1982 | Hara | |
| 4,345,262 A | 8/1982 | Shirato et al. | |
| 4,459,600 A | 7/1984 | Sato et al. | |
| 4,463,359 A | 7/1984 | Ayata et al. | |
| 4,558,333 A | 12/1985 | Sugitani et al. | |
| 4,608,577 A | 8/1986 | Hori | |
| 4,723,129 A | 2/1988 | Endo et al. | |
| 4,740,796 A | 4/1988 | Endo et al. | |
| 5,566,107 A | 10/1996 | Gilliam | 365/200 |

FOREIGN PATENT DOCUMENTS

| | | | |
|---|---|---|---|
| EP | 0 571 093 A2 | 5/1992 | G06K/19/07 |
| EP | 0 622 220 A2 | 11/1994 | B41J/11/46 |
| EP | 0 726 155 A2 | 8/1996 | B41J/2/21 |
| EP | 0 938 976 | 9/1999 | B41J/2/505 |
| EP | 0 948 188 A2 | 10/1999 | H04N/1/053 |
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |
| JP | 9-104113 | 4/1997 | B41J/2/05 |

*Primary Examiner*—Huan Tran
*Assistant Examiner*—K. Feggins
(74) *Attorney, Agent, or Firm*—Fitzpatrick, Cella, Harper & Scinto

(57) ABSTRACT

In ink jet printing by ejecting ink drops, a deviation in droplet ejection is corrected to less than one dot width. A delay value is determined from a deviation amount of dots formed by each nozzle array, and drive timing of an ejection heater is delayed in four steps in each of block units according to the delay value so as to adjust the ejection timing of an ink drop. Exact superposition of printing dots of ink and treatment liquid ejected from each nozzle array is thereby simply achieved.

12 Claims, 8 Drawing Sheets

| BENB VALUE | BENB 0 | BENB 1 | BENB 2 |
|---|---|---|---|
| 0 | L | L | L |
| 1 | H | L | L |
| 2 | L | H | L |
| 3 | H | H | L |
| 4 | L | L | H |
| 5 | H | L | H |
| 6 | L | H | H |
| 7 | H | H | H |

FIG.6

PRINTING APPARATUS HAVING CONTROL MEANS OF CONTROLLING TIMING FOR DRIVING BLOCKS OF PRINT ELEMENTS

This application is based on Patent Application No. 10-374795(1998) filed Dec. 28, 1998 in Japan, the content of which is incorporated hereinto by reference.

BACKGROUND OF THE INVENTION

1. Field of the Invention

The present invention relates to a print head provided with a plurality of printing elements, and a printing apparatus for making printing by scanning the print head on a printing medium, and a method for driving the print head.

2. Description of the Prior Art

Heretofore, printing apparatus have been known which print an image by ejecting ink drops from a plurality of nozzles as printing elements to form dots on a printing medium.

In these printing apparatus, recently according to requirements for multicolor images, those types are becoming popular, one in which print heads for ejecting respective different color inks are arranged in a scanning direction of a carriage, and one in which a plurality of nozzle arrays for ejecting inks of different colors by each nozzle array.

Further, to form a high-resolution image, arrangement intervals of respective nozzles in the print head tend to become smaller. However, reduction of the nozzle arrangement intervals has a limitation. Then, for higher integration, a print head is provided in which a plurality of nozzle arrays are arranged in zigzags in alternation.

Still further, recently, a printing method may be used in which before or immediately after ejecting ink drops to the. printing medium, a treatment liquid for insolubilizing a color material of dyes in the ink is ejected to mix the ink with the treatment liquid on the printing medium. The treatment liquid is normally colorless and transparent, and respective liquid drops of the treatment liquid and printing liquid are ejected so that the treatment liquid and printing liquid are superposed on each other. The two liquids are mixed on the printing medium before the liquids are absorbed into the medium and fixed to the printing medium. Using this method, color development and water resistance of the ink are improved thereby preventing the ink from bleeding. In particular, this is effective for ordinary plain paper which is not coated with an ink accept layer. Further, when printing on a plain paper, there is a case of ink spreading along paper fibers, that is, so-called featheting, the use of the above treatment liquid is effective for preventing such feathering. An apparatus using a print head in which nozzle arrays for treatment liquid and nozzle arrays of inks are disposed side by side, or an apparatus in which respective print heads for the treatment liquid and inks are disposed, is provided.

In the print head provided with a plurality of nozzle arrays arranged as above, it is necessary that liquid drops of ink or treatment liquid ejected from respective nozzle arrays to the same pixels are accurately superposed or deposited at a predetermined position. However, accurate superposition of respective dots of ink of respective colors and treatment liquid, or accurate deposition of respective liquid drops at a predetermined position in the same pixel requires a very high precision in the positions of nozzle arrays, ejection speed, distance between papers, and it is relatively difficult to perform such adjustment in the production stage. Therefore, it has been conventionally known as a method (hereinafter referred to as "user head position adjustment method") that a user of the printing apparatus previously makes it print a printing position adjustment pattern before performing printing and selects as ejection timing at which deposition positions coincide with each other, so that the printing position adjustment can be performed after the production stage.

Since a large amount of driving power is momentarily required to drive all of nozzles of the print head at the same time, a drive method in which nozzle arrays are divided into several blocks and drive is performed successively block by block (hereinafter referred to as "time division drive") is commonly used. In such time division drive, the blocks are driven to print respective vertical lines in association with movement of the carriage provided with the print head, and the vertical lines are deviated in the carriage moving direction by a predetermined amount for each block. Further, between respective scans, an end of a vertical line printed in a preceding scan is largely deviated from a connection which is an end of a vertical line printed in a succeeding scan. Due to the occurrence of such deviation, quality of formed image may sometimes be deteriorated. In order to cope with this problem, a method is proposed as described, for example, in Japanese Patent Application Laid-open No. 9-104113 (1997) in which nozzle arrays are disposed inclinedly by a predetermined angle, rather than vertically, and drive intervals between respective blocks are adjusted, thereby preventing especially connections from being deviated of between scans of vertical lines.

However, even with the drive interval adjustment method described in the above patent publication, merely the deviation of vertical line caused by block drive can be eliminated, but the overlap positions of inks or the like ejected from respective nozzle arrays cannot be adjusted. Further, since the above-described user head position adjustment method is 1-dot unit adjustment, a deviation of less than 1-dot cannot be adjusted.

Further, to perform the time division drive, it is necessary to send time division block signals to respective nozzle arrays, which has problems in that the number of head signals is increased, resulting in difficulty in routing of signal lines or an increase in cost. Therefore, a further increase of signal line for deposition position adjustment makes the problems even more intensified.

On the other hand, the print head of the structure in which two rows of nozzle array are arranged in zigzags and a supply port for supplying ink is provided at the center of the two rows of zigzag-arranged nozzle arrays is relatively low in strength, and structural changes tend to occur such that the two nozzle arrays are directed to the inside or, on the contrary, to the outside due to repeated ejections. Therefore, when printing is extended, a change tends to occur such that the deposition position of ejected ink drop is slightly deviated from an ideal position. However, for such a change in deposition position, the prior art printing apparatus has been impossible to make fine adjustment of deposition position of smaller than 1-dot unit.

SUMMARY OF THE INVENTION

It is therefore an object of the present invention to provide a print head and a printing apparatus and a print head driving method simply capable of forming print dots of ink and treatment liquid ejected from respective nozzle arrays at accurate positions.

A print head of the present invention is a print head provided with a plurality of printing element arrays each arranging a plurality of printing elements, said print head comprising:

a division drive circuit for dividing each of said plurality of printing element arrays into a plurality of drive blocks to drive a printing element for each of said plurality of drive blocks;

a driving timing input circuit for inputting a timing value indicating a timing of driving of the drive block; and a delay value input circuit for inputting a delay value indicating an amount of shifting the timing, said delay value being set corresponding to each of said printing element arrays, wherein said division drive circuit shifts a drive timing by drive blocks of drive time according to the delay value inputted by said delay value input circuit and performs driving of said plurality of drive blocks according to the timing value inputted by said driving timing input circuit.

A printing apparatus of the present invention is a printing apparatus provided with a plurality of printing element arrays each arranging a plurality of printing elements, said print head comprising:

a division drive means for dividing each of said plurality of printing element arrays into a plurality of drive blocks to drive a printing element for each of said plurality of drive blocks;

driving timing input means for inputting a timing value indicating a timing of driving of the drive block; and delay value input means for inputting a delay value indicating an amount of shifting the timing, said delay value being set corresponding to each of said printing element arrays, wherein said division drive means shifts a drive timing by drive blocks of drive time according to the delay value inputted by said delay value input means and performs driving of said plurality of drive blocks according to the timing value inputted by said driving timing input means.

A method for driving a print head of the present invention is a method for driving a print head provided with a plurality of printing element arrays each arranging a plurality of printing elements, said print head comprising:

a division drive step for dividing each of said plurality of printing element arrays into a plurality of drive blocks to drive a printing element for each of said plurality of drive blocks;

a driving timing input step for inputting a timing value indicating a timing of driving of the drive block; and a delay value input step for inputting a delay value indicating an amount of shifting the timing, said delay value being set corresponding to each of said printing element arrays, wherein said division drive step shifts a drive timing by drive blocks of drive time according to the delay value inputted by said delay value input step and performs driving of said plurality of drive blocks according to the timing value inputted by said driving timing input step.

According to the above configuration, since driving level can be set for each printing element and drive timing of each drive block be determined according to the driving level, adjustment of less than 1-dot of printing position is possible in a unit of each printing element array.

The above and other objects effects, features and advantages of the present invention will become more apparent from the following description of embodiments thereof taken in conjunction with the accompanying drawings.

BRIEF DESCRIPTION OF THE DRAWINGS

FIG. 6 is a diagram showing the relationship between BENB value and each block enable signal;

DESCRIPTION OF THE PREFERRED EMBODIMENTS

Embodiments to which the present invention is applied will be described in the following.

Figure 1:
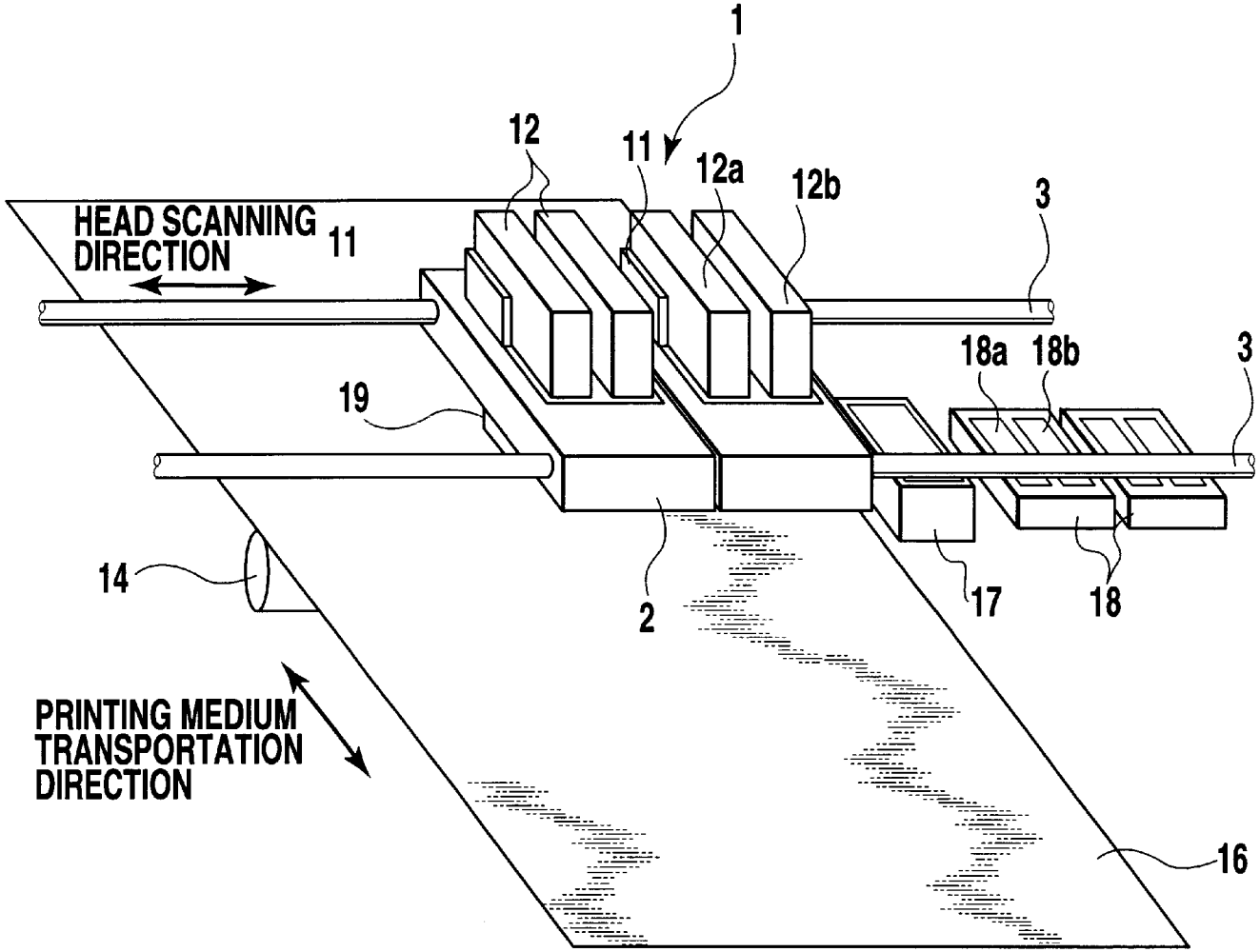
FIG. 1 is a perspective diagram showing the printing apparatus according to the present invention.

FIG. 1 is a schematic diagram showing a print head part of an ink-jet printer as an embodiment of the present invention.

The ink jet printer is to eject an ink from a print head part 1 onto a printing medium to form an image. The print head part 1 is equipped with an ink tank 12 through a head cartridge 11. The print head part 1 is disposed on a carriage 2. The carriage 2 moves on a printing medium 16 along a guide shaft 3 and during the movement ejects the ink from the print head part 1 to make printing. This carriage movement is referred to as a primary scanning, and the moving direction is referred to as a primary scanning direction.

Figure 2A:
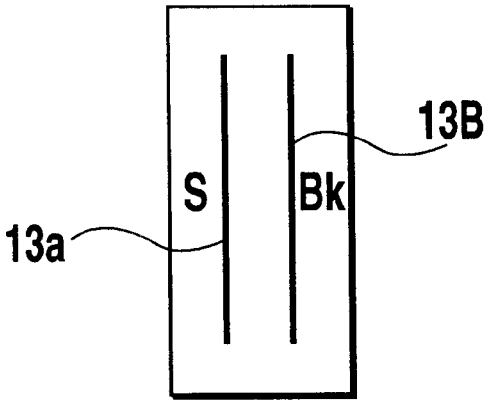
FIGS. 2A and 2B are front diagrams showing the print head according to the present invention.
Figure 2B:
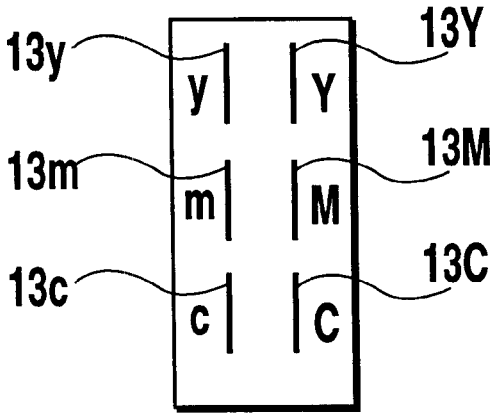

The present embodiment is provided with two units of the print head part 1, and FIGS. 2A and 2B are diagrams showing these print head parts 1 as viewed from the lower side.

The print head part 1 shown in FIG. 2A has a nozzle array 13*a* for ejecting a treatment liquid and a nozzle array 13B for ejecting a black (B) ink, arranged in parallel. The print head part 1 shown in FIG. 2B has a nozzle array 13Y for ejecting a yellow ink, a nozzle array 13M for ejecting a magenta ink, and a nozzle array 13C for ejecting a cyan ink, which are arranged in a line, and a nozzle array 13*y* for ejecting a pale yellow ink, a nozzle array 13*m* for ejecting a pale magenta ink, and a nozzle array 13*c* for ejecting a pale cyan ink, which are arranged in another line. Two sets of nozzle arrays each of which includes respective nozzle arrays are further arranged in parallel. The treatment liquid and ink ejected from the respective nozzle arrays 13 are superposed on the same pixel to form a variety of colors. In the present embodiment, the print head part 1 has two nozzle arrays, however, the present invention is not limited to this configuration, but each ink color may have a row of nozzle array, and any number of nozzle arrays be used which comprise a plurality of nozzle arrays rather than two nozzle arrays.

The print head part 1, in association with the movement of the carriage 2, ejects the treatment liquid or ink from the nozzle array as it moves on the printing medium 16 thus making printing. When the print head part 1 moves to an end of the printing medium 16, the printing medium 16 is moved by a predetermined amount in a direction of arrow q by a transportation roller 14. As described above, scanning of the print head part 1 and movement of the printing medium 16 can be repeated to make printing over the entire area of the printing medium 16.

During non-printing, the print head part 1 is moved to a home position. At the home position, a cap 18 (see FIG. 1) is provided for nozzle protection. The cap 18 is formed of an elastic material such as rubber, which is disposed to oppose the nozzle array surface of the print head part 1. The cap 18 is used not only for nozzle protection, but also to remove the treatment liquid or ink adhered in the vicinity of the ejection opening, or to remove bubbles stayed in the liquid chamber for storing ink during ejection or in the nozzle itself. In the method of removal, the cap 18 is fixed to the print head part 1 so that the cap 18 contacts close to the nozzle array, and suction is made by a suction pump (not shown) provided on the backside of the cap, thereby forcibly sucking adhered ink or bubbles through the cap. Since, in the present embodiment, the treatment liquid nozzle array and the ink nozzle array are provided on the same head, to prevent removed treatment liquid from adhering to the ink in the nozzle and solidifying and becoming unremovable, two types of caps of treatment liquid cap 18*a* and ink cap 18*b* are provided. Respective removal operations are performed using the two types of caps.

Furthermore, bubbles or dust collected in the nozzles, or ink or the like which increases in viscosity and becomes unsuitable for printing are discharged. That is, an ink discharge port 17 (see FIG. 1) for performing ejection recovery processing is provided at the neighbor of the cap 18. The print head part 1 ejects ink or treatment liquid with the nozzle array opposed to the ink discharge port 17, thereby removing the above bubbles or dust or unnecessary ink from the nozzles.

Next, circuit configuration of the respective nozzle array of the print head part 1 will be described.

Figure 3:
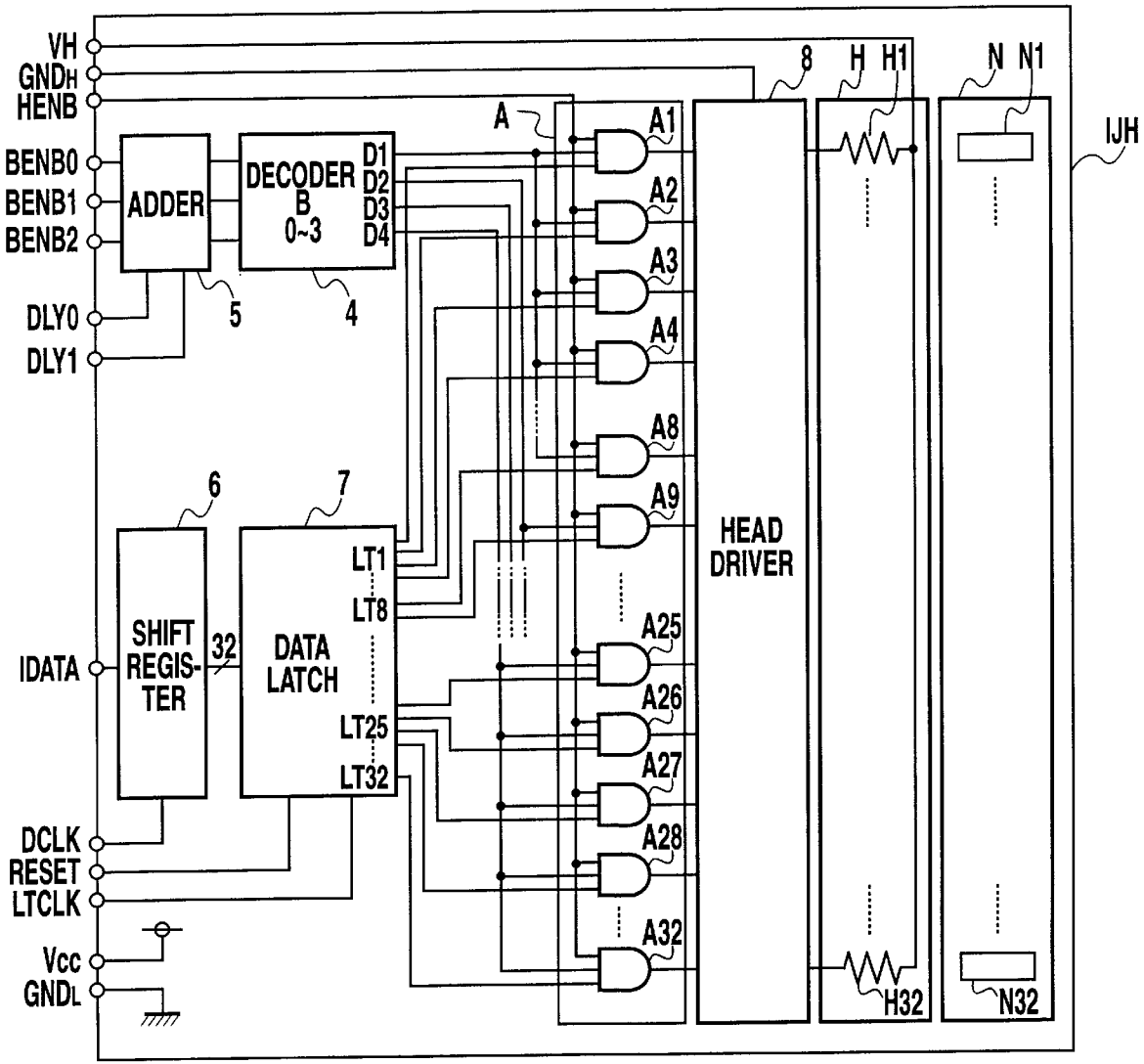
FIG. 3 is a drive circuit diagram of the print head according to the present invention.

FIG. 3 is a block diagram showing circuit configuration corresponding to one nozzle array of the print head part 1. A nozzle group N comprising 32 nozzles of ejection opening N 1 . . . N 32 is connected with ejection heaters H 1 . . . H 32 corresponding to the respective ejection openings. The generation of heat by the ejection heater causes film boiling in the ink to generate a bubble. By this bubble generation pressure, an ink drop is ejected.

Which ejection opening performs ejection is determined by a shift register 6 according to an image data IDATA sent from a control part (not shown). The image data IDATA is inputted bit by bit to the shift register 6 every time a clock signal DCLK is inputted. When an image data of an amount of 32 bits is completed in the shift register 6, it is sent to a data latch circuit 7. The data latch circuit 7 is provided with 32 output terminals LT 1 . . . LT 32 corresponding to the respective ejection openings, and produces latch signals for respective output terminals according to the inputted image data. The output terminals are connected respectively to AND gates, and the latch signals are sent to the AND gates according to the sign of the clock signal LTCLK. In the AND gates, the latch signals are ANDed with drive signals D1, D2, D3, and D4 (details described later) for controlling drive timing inputted from another path in the circuit, and the result is sent as an ejection signal to the ejection heater through a head driver 8. As described above, the ejection heater performs heat generation operation of the heater according to the ejection signal.

Here, since an electric power for all of the 32 ejection heaters to generate heat at a time cannot be sent, the ejection heaters are divided into 4 blocks of eight units in the order from H1, and heat generation operation is performed in a unit of block. Therefore, time division ejection is performed in block units of division order such as the ejection opening N1 . . . N8 as the first block, and the ejection opening N9 . . . N16 as the second block.

Therefore, drive signals D1, D2, D3, and D4 divided into blocks are inputted to the AND gates. Drive signal D1 is a signal for driving the ejection heater H1 . . . H8 of block 1, drive signal D2 is a signal for driving the ejection heater H9 . . . H16 of block 2, drive signal D3 is a signal for driving the ejection heater H17 . . . H24 of block 3, and drive signal D4 is a signal for driving the ejection heater H24 . . . H32 of block 4. From these drive signals and the latch signals from the data latch circuit 7, ejection signals for blocks are produced by the AND gates.

Figure 4:
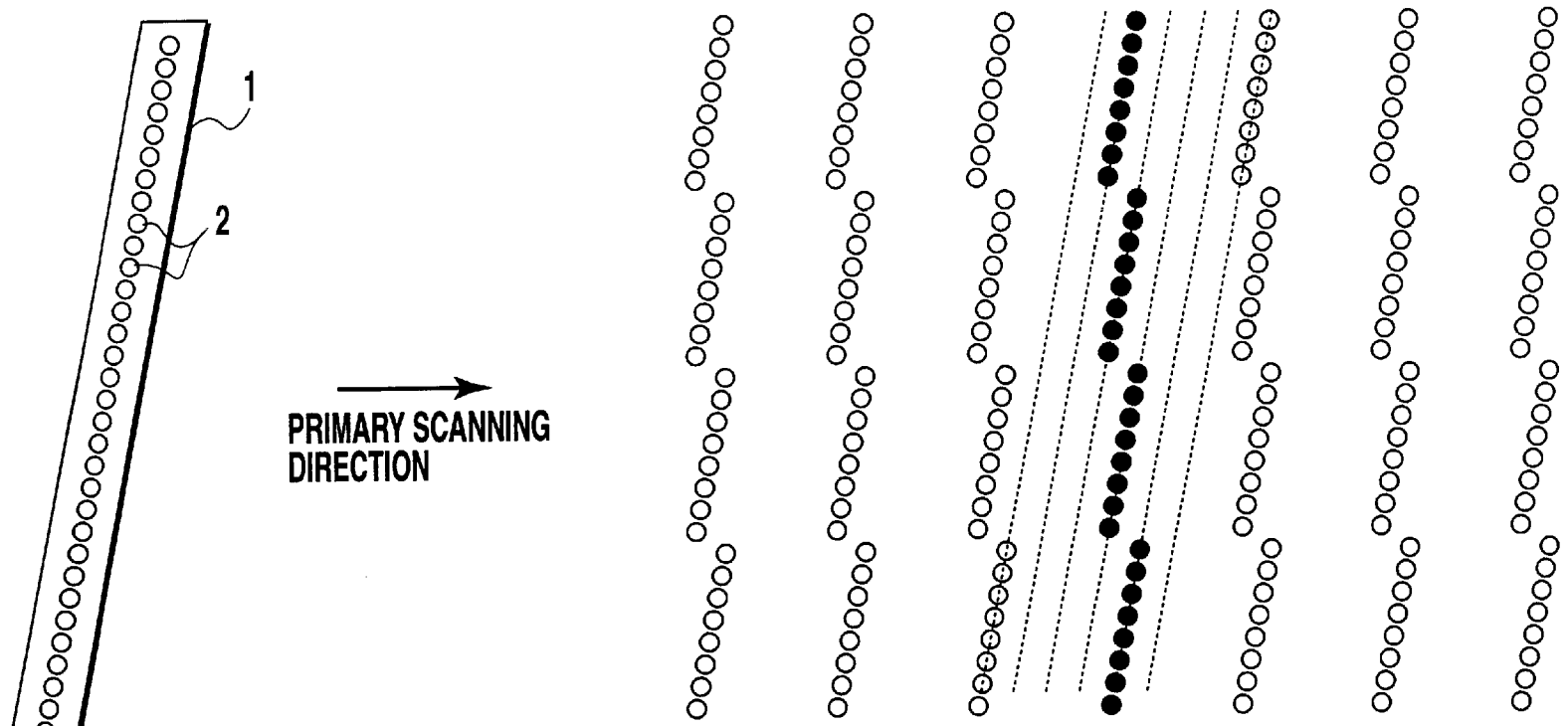
FIG. 4 is a model diagram showing time division printing.

Since the carriage moves while printing as above, as shown in FIG. 4, connection between blocks is deviated between print dot of the first block and print dot of the second block. Because the deviation width is changed by ejection timing of every block, the ejection timing can be adjusted to reduce the deviation width.

As described above, the print head part 1 has a plurality of nozzle arrays, each nozzle array is time division driven so that ink or treatment liquid of each nozzle array are superposed on the same pixel, or correctly deposited at a predetermined position in the same pixel, thereby forming a variety of colors. However, since, in time division driving, the carriage is moving, deviation tends to generate between blocks, and it is difficult to exactly overlap dots of respective inks without dot deviation. Then, in the present embodiment, deviation of respective dots is adjusted by adding a delay signal for shifting timing to the factor for producing drive signals D1, D2, D3 and D4. This adjustment is performed as follows.

The control part determines a dot deviation from a previously recorded test pattern or the like, and a delay value (also referred to as "drive level") is determined according to the determined deviation amount. Delay signals DLY0 and DLY1 representing the delay value are sent to the drive circuit of the corresponding nozzle array. The drive circuit determines the delay value from the combination of the delay signals DLY0 and DLY1 sent from the control part. For example, when both of DLY0 and DLY1 are at "low level" (hereinafter referred to as "L level"), it is determined to be delay 0. When DLY0 is "L level" and DLY1 is at "high level" (hereinafter referred to as "H level"), it is determined to be delay 2. When both of DLY0 and DLY1 are H level, it is determined to be delay 4. According to the delay value, a decoder 4 adjusts the ejection timing such that, at the time of delay 2, the ejection timing is shifted by 2 blocks with respect to the time of delay 0, and at the time of delay 4, shifted by 4 blocks. Details of ejection timing adjustment will be described later.

In the present embodiment, the delay value is determined by the control part according to a previously recorded test pattern, however, the present invention is not limited to this method, but the delay value may be flexibly set by the user, or fixed to a delay value determined by measurement at the delivery inspection. The configuration where the delay value is determined every time the test pattern is recorded is effective for the case when warping or deflection of the nozzle array are generated due to repeated uses and the ejection direction is changed.

In the decoder 4, the delay signals D1, D2, D3 and D4 are formed on the basis of three block enable signals BENB 0, BENB 1 and BENB 2, and heat enable signal HENB sended from the control part, in addition to the delay signals DLY 0 and DLY 1.

Figure 5A:
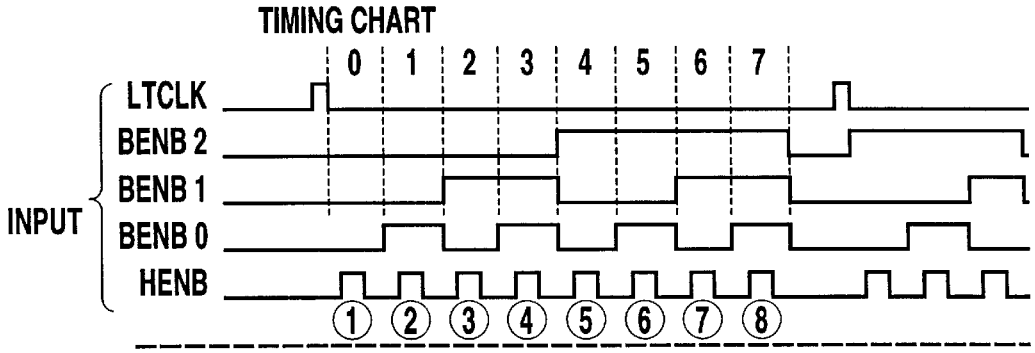
FIG. 5A is a timing chart showing input signal of the print head.

The block enable signals and the heat enable signal are outputted respectively in a predetermined period by the input of the latch clock signal LTCLK as shown in FIG. 5A.

The heat enable signal HENB is outputted eight times within the predetermined period as pulse signals of the same intervals each of which is triggered by the input of the latch clock signal LTCLK. When the heat enable signal is "H level", the ejection heater generates heat.

On the other hand, the block enable signals BENB 0, BENB 1 and BENB 2 are outputted in periods different from each other by the input of the latch clock signal LTCLK. BENB value (also referred to as "timing value") is determined by a combination of output states of the respective block enable signals. When all of BENB 0, BENB 1 and BENB 2 are "L level", BENB value is determined as 0, and when BENB 0 is "H level" and BENB 1 and BENB 2 are "L level", BENB value is determined as 1. The thus determined BENB values are as shown in the table shown in FIG. 6. In the decoder 4, the delay signals D1, D2, D3 and D4 are formed by combinations of BENB value and delay value. Formation method of the drive signals will be described in detail in the following.

Figure 5B:
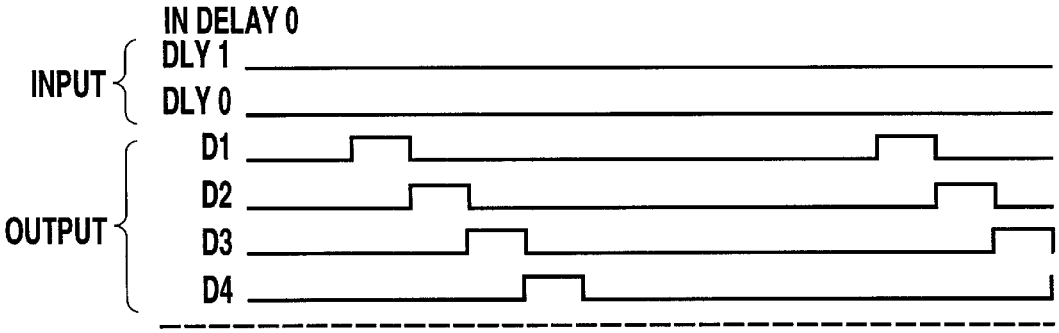
FIG. 5B is a timing chart showing output signal of the print head in DELAY 0.

First, as shown in FIG. 5B when all of DLY 0 and DLY 1 are "L level", that is, at the time of delay 0, the output timing is not shifted. When BENB value is 0, drive signal D1 is set to H level. At the leading edge timing of the heat enable signal HENB (section (1) in FIG. 5A), the ejection heaters H1 to H8 are driven and ink is ejected from corresponding nozzles N1 to N8.

After BENB value 0 is outputted for a certain period of time, when BENB value changes to 1, drive signal D1 is set to "L level" and drive signal D2 is set to "H level". At the leading edge timing of the heat enable signal HENB (section (2) in FIG. 5A), the ejection heaters H9 to H16 are driven and ink is ejected from the corresponding nozzles N9 to N16.

After BENB value 1 is outputted for a certain period of time, when BENB value changes to 2, drive signal D2 is set to "L level" and drive signal D3 is set to "H level". At the leading edge timing of the heat enable signal HENB (section (3) in FIG. 5A), the ejection heaters H17 to H24 are driven and ink is ejected from the corresponding nozzles N17 to N24.

After BENB value 2 is outputted for a certain period of time, when BENB value changes to 3, drive signal D2 is set to "L level" and drive signal D3 is set to "H level". At the leading edge timing of the heat enable signal HENB (section (4) in FIG. 5A), the ejection heaters H25 to H32 are driven and ink is ejected from the corresponding nozzles N25 to N32.

Figure 5C:
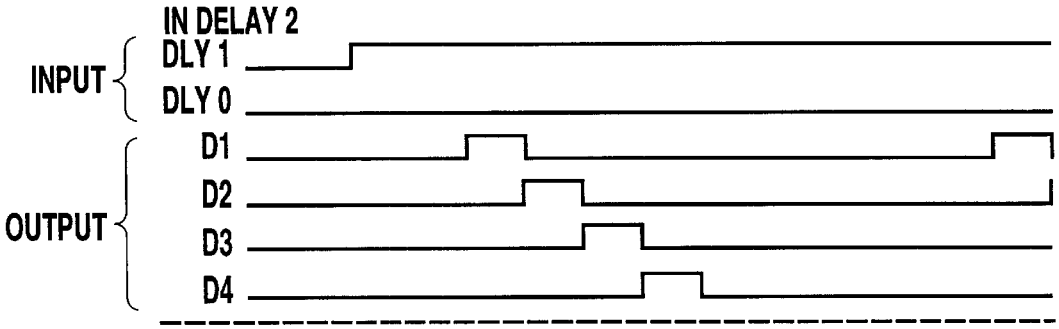
FIG. 5C is a timing chart showing output signal of the print head in DELAY 2.

Next, as shown in FIG. 5C, since, when DLY0 is "L level" and DLY 1 is "H level", that is, at the time of delay 2, the output timing is shifted by 2 blocks, when BENB value is 0 and when BENB value is 1, any drive signal is set to "L level".

After BENB value 1 is outputted for a certain period of time, when BENB value changes to 2, drive signal D1 is set to "H level". At the leading edge timing of the heat enable signal HENB (section (3) in FIG. 5A), the ejection heaters H1 to H8 are driven and ink is ejected from the corresponding nozzles N1 to N8.

After BENB value 2 is outputted for a certain period of time, when BENB value changes to 3, drive signal D1 is set to "L level" and drive signal D2 is set to "H level". At the leading edge timing of the heat enable signal HENB (section (4) in FIG. 5A), the ejection heaters H9 to H16 are driven and ink is ejected from the corresponding nozzles N9 to N16.

After BENB value 3 is outputted for a certain period of time, when BENB value changes to 4, drive signal D2 is set to "L level" and drive signal D3 is set to "H level". At the leading edge timing of the heat enable signal HENB (section (5) in FIG. 5A), the ejection heaters H17 to H24 are driven and ink is ejected from the corresponding nozzles N17 to N24.

After BENB value 4 is outputted for a certain period of time, when BENB value changes to 5, drive signal D2 is set to "L level" and drive signal D3 is set to "H level". At the leading edge timing of the heat enable signal HENB (section (6) in FIG. 5A), the ejection heaters H25 to H32 are driven and ink is ejected from the corresponding nozzles N25 to N32.

Figure 5D:
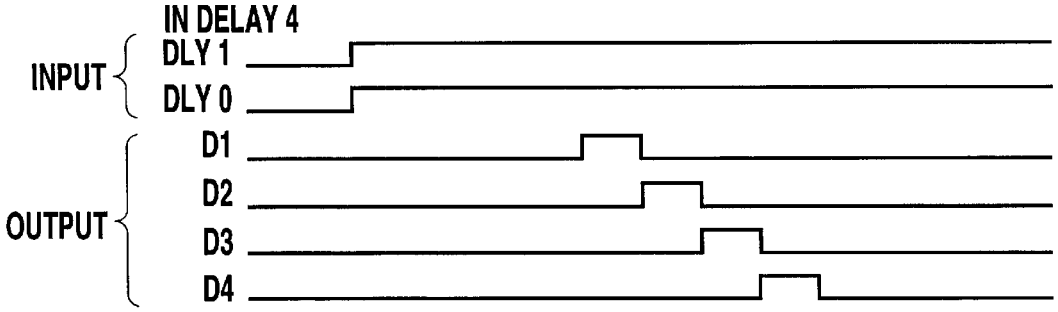
FIG. 5D is a timing chart showing output signal of the print head in DELAY 4.

Next, as shown in FIG. 5D, since, when all of DLY 0 and DLY 1 are "H level", that is, at the time of delay 4, the output timing is shifted by 4 blocks. when BENB value is 0, 1, 2 or 3, any drive signal is set to "L level".

After BENB value 3 is outputted for a certain period of time, when BENB value changes to 4, drive signal D1 is set to "H level". At the leading edge timing of the heat enable signal HENB (section (5) in FIG. 5A), the ejection heaters H1 to H8 are driven and ink is ejected from the corresponding nozzles N1 to N8.

After BENB value 4 is outputted for a certain period of time, when BENB value changes to 5, drive signal D1 is set to "L level" and drive signal D2 is set to "H level". At the leading edge timing of the heat enable signal HENB (section (6) in FIG. 5A), the ejection heaters H9 to H16 are driven and ink is ejected from the corresponding nozzles N9 to N16.

After BENB value 5 is outputted for a certain period of time, when BENB value changes to 6, drive signal D2 is set to "L level" and drive signal D3 is set to "H level". At the leading edge timing of the heat enable signal HENB (section (7) in FIG. 5A), the ejection heaters H17 to H24 are driven and ink is ejected from the corresponding nozzles N17 to N24.

After BENB value 6 is outputted for a certain period of time, when BENB value changes to 7, drive signal D2 is set to "L level" and drive signal D3 is set to "H level". At the leading edge timing of the heat enable signal HENB (section (8) in FIG. 5A), the ejection heaters H25 to H32 are driven and ink is ejected from the corresponding nozzles N25 to N32.

That is, since all blocks of nozzle array are driven in 4 drive periods, at the time of delay 0 ejection is made when BENB value is 0, 1, 2, or 3, at the time of delay 2 ejection is made when BENB value is 2, 3, 4, or 5, at the time of delay 4 ejection is made when BENB value is made when BENB value is 4, 5, 6, or 7. That is, it may be considered that ejection is made when a value of each BENB value subtracted by delay value is 0, 1, 2, or 3. In the present embodiment, the delay value is only three types of 0, 2, and 4, however, delay value is not limited to the three types.

Figure 7:
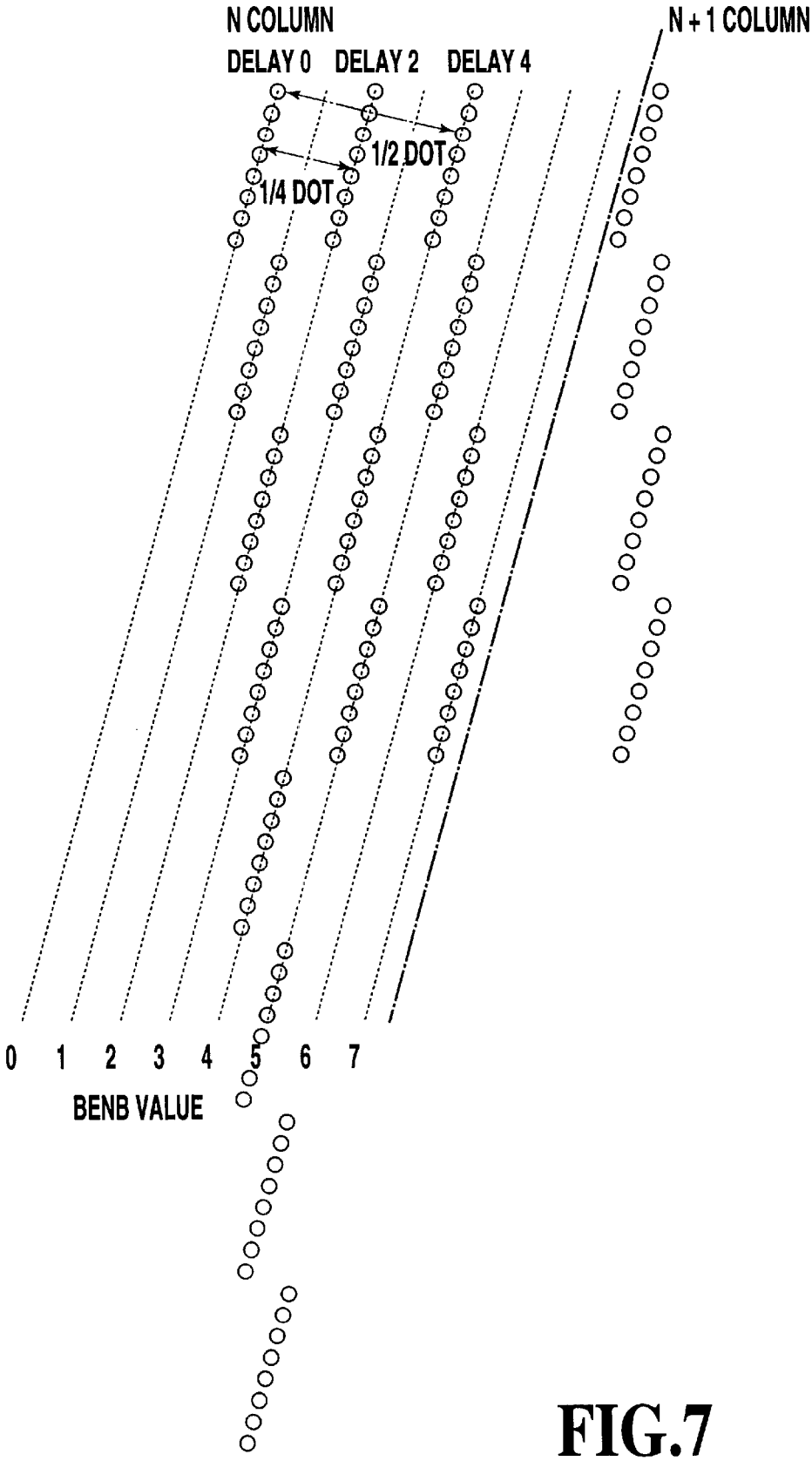
FIG. 7 is a model diagram showing time division printing at respective times of delay 0, delay 2, and delay 4.

By using the delay value as shown above, the ejection timing can be slightly shifted. FIG. 7 schematically shows printing dot position of each delay value. The dot diameter is shown in a small size for simplicity, however, in practice, the dot diameter is so large that the printing area is filled with N column and N+1 column. Since print dot deposit position in the primary scanning direction can be shifted by up to ¼ dot in delay 2, and up to ½ dot in delay 4, the deposit position can be adjusted by up to ½ dot by selection of the delay value.

Embodiment 2

In Embodiment 1, DLY terminal is provided in the circuit and inputted with a delay signal, however, in this embodiment, delay value is set inside the circuit by fuse cutting in the head. This is made such that in the delivery inspection of the print head, a deposit deviation amount is previously measured, and a fuse in the print head is cut according to the delay value corresponding to the measured deposit amount, thereby setting DLY 0 and DLY 1.

Figure 8:
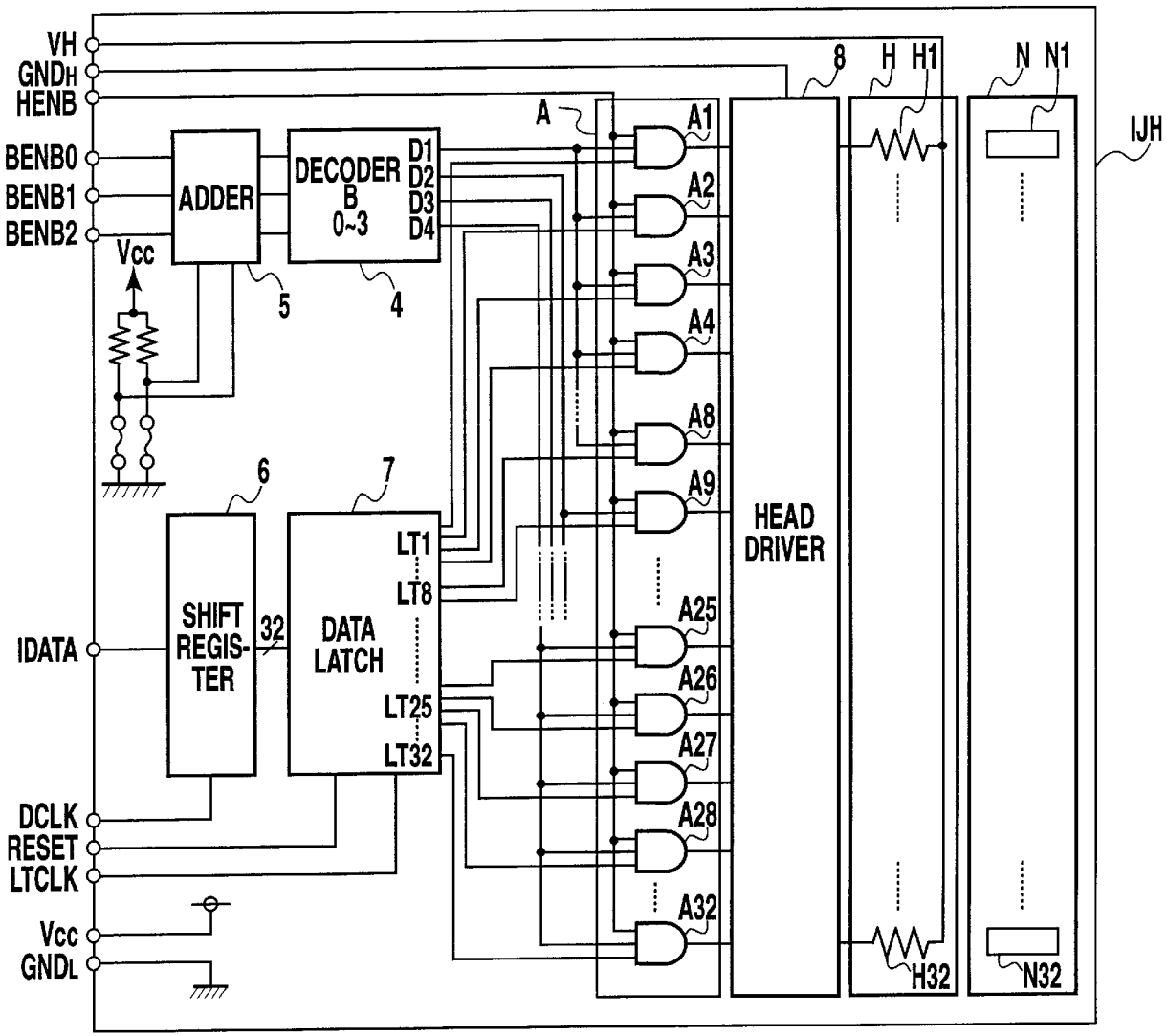
FIG. 8 is a drive circuit diagram of the print head according to an embodiment 2.

FIG. 8 is a circuit diagram of the nozzle array according to the present embodiment. A fuse 10 is connected to an adder 5, when the fuse is cut, a Vcc power supply output value, that is, "H level" is selected, and when the fuse is not cut, GNDL, that is, "L level" is selected. By this method, delay value can be set for every nozzle array of the print head. Ejection timing adjustment after setting the delay value is the same as in Embodiment 1.

Fuse cutting is made such that a deposit deviation amount is previously measured at the time of delivery inspection of the print head, a delay value corresponding to the deposit deviation is determined, and the fuse is cut according to the delay value.

This method is effective for the case where print dot of each nozzle array is deviated for a reason of the print head production process, and this method can be applied in the same configuration as the prior art without modification of the control part.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

According to the present invention, since drive level (delay value) can be set for each nozzle array, and drive timing of each drive block be determined according to the drive level, print dots of every nozzle array be exactly overlapped.

Further, by measuring dot deviation by test pattern printing and setting the drive level according to the measured dot deviation, dot deviation due to structural changes caused by excessive use can be appropriately corrected.

Still further, when respective nozzle arrays are produced using standardized components and delivered in the state with the drive previously set according to the dot deviation detected at the time of production inspection, print head cost or printing apparatus cost can be reduced to a low value.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. A print head provided with a plurality of printing element arrays each having a plurality of printing elements, said print head comprising:

a division drive circuit for dividing each of said plurality of printing element arrays into a plurality of drive blocks to drive plural printing elements for each of said plurality of drive blocks;

a block selection data input circuit for inputting block selection data and for selecting a drive block from among said plurality of drive blocks based on the block selection data; and a delay value input circuit for inputting a delay value indicating an amount by which timing is shifted for a beginning of said selecting of a drive block, wherein the timing of the beginning of said selecting of a drive block is shifted according to the delay value inputted by said delay value input circuit and wherein said division drive circuit performs driving of the drive block selected by said block selection data input circuit.

2. The print head as claimed in claim 1, further comprising a delay value determination circuit for determining a fuse cutting level according to a previously measured dot deposit deviation amount, and for determining the delay value according to presence of said fuse cutting, wherein said delay value input circuit inputs the delay value determined by said delay value determination circuit.

3. The print head as claimed in claim 1, wherein said printing element utilizes thermal energy to generate a bubble in ink and said ink is ejected by generation pressure of said bubble.

4. The print head as claimed in claim 1, wherein said delay value input circuit inputs the delay value so as to adjust printing positions of all of the plurality of printing element arrays.

5. A printing apparatus provided with a plurality of printing element arrays each having a plurality of printing elements, said printing apparatus comprising:

a division drive means for dividing each of said plurality of printing element arrays into a plurality of drive blocks to drive plural printing elements for each of said plurality of drive blocks;

a block selection data input means for inputting block selection data and for selecting a drive block from among said plurality of drive blocks based on the block selection data; and a delay value input means for inputting a delay value indicating an amount by which timing is shifted for a beginning of said selecting of a drive block, wherein the timing of the beginning of said selecting of a drive block is shifted according to the delay value inputted by said delay value input means and wherein said division drive means performs driving of the drive block selected by said block selection data input means.

6. The printing apparatus as claimed in claim 5, further comprising delay value determination means for determining a deposit deviation amount from a previously printed test pattern, and for determining the delay value according to said deposit deviation amount, wherein said delay value input means inputs the delay value determined by said delay value determination means.

7. The printing apparatus as claimed in claim 5, wherein said printing element utilizes thermal energy to generate a bubble in ink and said ink is ejected by generation pressure of said bubble.

8. The printing apparatus as claimed in claim 5, wherein said delay value input means inputs the delay value so as to adjust printing positions of all of the plurality of printing element arrays.

9. A method for driving a print head provided with a plurality of printing element arrays each having a plurality of printing elements, said print head comprising:

a division drive step for dividing each of said plurality of printing element arrays into a plurality of drive blocks to drive plural printing elements for each of said plurality of drive blocks;

a block selection data input step for inputting block selection data and for selecting a drive block from among said plurality of drive blocks based on the block selection data; and a delay value input step for inputting a delay value indicating an amount by which timing is shifted for a beginning of said selecting of a drive block, wherein the timing of the beginning of said selecting of a drive block is shifted according to the delay value inputted by said delay value input step and wherein said division drive step performs driving of the drive block selected by said block selection data input step.

10. The method for driving a print head as claimed in claim 9, further comprising a delay value determination step for determining a dot deposit deviation amount from a previously printed test pattern, and for determining the delay value according to said deposit deviation amount, wherein said delay value input step inputs the delay value determined by said delay determination step.

11. The method for driving a print head as claimed in claim 9, further comprising a delay value determination step for determining a fuse cutting level according to a previously measured dot deposit deviation amount, and for determining the delay value according to presence of said fuse cutting, wherein said delay value input step inputs the delay value determined by said delay value determination step.

12. The method for driving a print head as claimed in claim 7, wherein said delay value input step inputs the delay value so as to adjust printing positions of all of the plurality of printing element arrays.

* * * * *

UNITED STATES PATENT AND TRADEMARK OFFICE

CERTIFICATE OF CORRECTION

PATENT NO. : 6,460,976 B1
DATED : October 8, 2002
INVENTOR(S) : Masaki Oikawa

It is certified that error appears in the above-identified patent and that said Letters Patent is hereby corrected as shown below:

Title page,
Item [56], References Cited, U.S. PATENT DOCUMENTS, insert:

| | | |
|---|---|---|
| -- 5,933,161 | 8/1999 | Sato et al. |
| 6,139,126 | 10/2000 | Ayata et al. |
| 6,102,510 | 8/2000 | Kikuta et al. --; and |

FOREIGN PATENT DOCUMENTS, insert:
-- JP 9-254368 A 9/1997 …….. B41J/2/01 --.

Column 1,
Line 32, "zigzags in alternation." should read -- alternating zigzags. --;
Line 49, "featheting" should read -- feathering --; and
Line 59, "are" should read -- be --.

Column 2,
Line 26, "from being deviated of" should be deleted;
Line 27, "lines." should read -- lines from being deviated. --;
Line 31, "line" should read -- lines --; and
Line 55, "impossible" should read -- unable --.

Column 3,
Line 57, "be" should read -- can be --; and
Line 60, "objects" should read -- objectives, --.

Column 4,
Line 61, "array," should read -- arrays, -- and "be" should read -- can be --.

Column 5,
Line 14, "stayed" should read -- remaining --; and
Line 41, "opening" should read -- openings --.

Column 6,
Line 1, "an" should be deleted;
Line 2, "a" should read -- one --;
Line 5, "unit of bbck." should read -- block of units. --;
Line 19, "while" should read -- during --; and
Line 31, "generate" should read -- be generated --.

UNITED STATES PATENT AND TRADEMARK OFFICE

CERTIFICATE OF CORRECTION

PATENT NO. : 6,460,976 B1
DATED : October 8, 2002
INVENTOR(S) : Masaki Oikawa

It is certified that error appears in the above-identified patent and that said Letters Patent is hereby corrected as shown below:

Column 7,
Line 3, "sended" should read -- sent --.

Column 8,
Line 24, "when" should read -- When --; and
Line 53, "array" should read -- arrays --.

Column 10,
Line 1, "to" should read -- into --.

Column 11,
Line 11, "be" should read -- can be --;
Line 12, "be" should read -- can be --; and
Line 27, "invention," should read -- intention, --.

Column 12,
Line 63, "claim 7," should read -- claim 9, --.

Signed and Sealed this

Twenty-first Day of October, 2003

JAMES E. ROGAN
*Director of the United States Patent and Trademark Office*